US011020633B2

(12) United States Patent
Sanford

(10) Patent No.: US 11,020,633 B2
(45) Date of Patent: Jun. 1, 2021

(54) PERSONAL STRUCTURE CLIMBING APPARATUS

(71) Applicant: Grant Jonathan Sanford, Seatac, WA (US)

(72) Inventor: Grant Jonathan Sanford, Seatac, WA (US)

( * ) Notice: Subject to any disclaimer, the term of this patent is extended or adjusted under 35 U.S.C. 154(b) by 0 days.

(21) Appl. No.: 15/095,438

(22) Filed: Apr. 11, 2016

(65) Prior Publication Data

US 2016/0310795 A1 Oct. 27, 2016

Related U.S. Application Data

(60) Provisional application No. 62/178,822, filed on Apr. 21, 2015, provisional application No. 62/231,028, filed on Jun. 23, 2015.

(51) Int. Cl.
*A63B 27/00* (2006.01)

(52) U.S. Cl.
CPC ..... *A63B 27/00* (2013.01); *A63B 2225/09* (2013.01)

(58) Field of Classification Search
CPC ..... A63B 27/02; A63B 27/00; A63B 2225/09; B60R 3/02; E06C 1/34; E06G 3/20
See application file for complete search history.

(56) References Cited

U.S. PATENT DOCUMENTS 664,508 A * 12/1900 Smith ..... A63B 27/00 182/136
1,091,277 A * 3/1914 Bloom ..... A63B 27/02 182/134
1,260,856 A * 3/1918 Bates ..... A63B 27/02 182/134
1,535,978 A * 4/1925 Baker ..... A63B 27/00 182/187
2,021,433 A * 11/1935 Shaw ..... A63B 27/04 182/134
3,172,499 A * 3/1965 Stairs ..... B60R 3/02 182/97
5,133,429 A * 7/1992 Densley ..... B60R 3/007 182/150
5,277,273 A 1/1994 Grimes
5,417,130 A 5/1995 Robl
5,456,479 A * 10/1995 Conger ..... B60R 3/007 280/165

(Continued)

FOREIGN PATENT DOCUMENTS

DE 10201965 A1 * 7/2003 ..... A63B 27/00
DE 10201965 A1 * 7/2003 ..... E06C 7/12

(Continued)

OTHER PUBLICATIONS 29 pages of Column Climber product website, Charlotte, North Carolina, United States, +1-980-288-5239, sales@column-climber.com; http://column-climber.com/; dated Mar. 1, 2017.

*Primary Examiner* — Alvin C Chin-Shue
*Assistant Examiner* — Candace L Bradford

(57) ABSTRACT

A personal climbing apparatus formed of a hanger having a blade extended from a shank and forming a gap therebetween; a foot-support platform that is oriented transversely to the shank of the hanger and coupled thereto and having a foot retainer; and a brace coupled between the foot-support platform and the shank of the hanger.

8 Claims, 7 Drawing Sheets

(56) References Cited

U.S. PATENT DOCUMENTS

| | | | | | |
|---|---|---|---|---|---|
| 5,503,358 | A * | 4/1996 | Lapp | E04G 3/20 | 182/82 |
| 5,806,628 | A * | 9/1998 | Fullam | E04G 5/06 | 182/134 |
| 5,934,410 | A | 8/1999 | Mahr | | |
| 6,003,631 | A * | 12/1999 | Knauth | E04G 3/20 | 182/82 |
| 6,041,891 | A | 3/2000 | Fullam et al. | | |
| 6,386,321 | B1 * | 5/2002 | Muhich | A01M 31/02 | 182/187 |
| 6,422,339 | B1 * | 7/2002 | Wisler | E04G 3/22 | 182/150 |
| 6,752,243 | B1 * | 6/2004 | Terzini | A47B 57/56 | 182/92 |
| 6,896,101 | B2 | 5/2005 | Cowin | | |
| 6,951,072 | B2 | 10/2005 | Schurtenberger | | |
| 7,052,447 | B2 | 5/2006 | Whittaker | | |
| 7,588,123 | B2 | 9/2009 | Woller et al. | | |
| 8,418,808 | B2 | 4/2013 | Merritt | | |
| 10,080,362 | B1 * | 9/2018 | Alexander | A47C 9/10 | |
| 2005/0199441 | A1 * | 9/2005 | Thery | E04G 3/20 | 182/82 |
| 2006/0175130 | A1 * | 8/2006 | Riley | E04G 3/20 | 182/82 |
| 2010/0300808 | A1 * | 12/2010 | Hale | A01M 31/02 | 182/187 |
| 2011/0297481 | A1 * | 12/2011 | Copus | A01M 31/02 | 182/113 |
| 2012/0080269 | A1 * | 4/2012 | Furseth | A01M 31/02 | 182/187 |
| 2012/0199418 | A1 * | 8/2012 | Priest | A01M 31/02 | 182/129 |
| 2014/0166400 | A1 * | 6/2014 | Berkbuegler | A01M 31/02 | 182/129 |
| 2014/0190767 | A1 * | 7/2014 | Wheelington | A01M 31/02 | 182/129 |
| 2017/0265454 | A1 * | 9/2017 | Kramer | A01M 31/02 | |
| 2019/0055782 | A1 * | 2/2019 | Infalt | E06C 1/381 | |
| 2020/0253190 | A1 * | 8/2020 | D'Acquisto | A63B 27/00 | |
| 2021/0076666 | A1 * | 3/2021 | Power, II | F16B 2/08 | |

FOREIGN PATENT DOCUMENTS

| | | | | |
|---|---|---|---|---|
| DE | 2628508 | A1 * | 8/2013 | A63B 27/02 |
| EP | 2628508 | A1 * | 8/2013 | A63B 27/02 |
| FR | 3000975 | A1 * | 7/2014 | E04G 3/20 |
| FR | 3000975 | A1 * | 7/2014 | E04G 5/062 |
| WO | WO 9947767 | A1 * | 9/1999 | E04G 3/20 |
| WO | WO-9947767 | A1 * | 9/1999 | E04G 5/048 |

* cited by examiner

PERSONAL STRUCTURE CLIMBING APPARATUS

This application claims priority benefit of parent U.S. Provisional Patent Application No. 62/178,822 filed in the name of Grant Jonathan Sanford on Apr. 21, 2015, the complete disclosure of which is incorporated herein by reference, and further claims priority benefit of parent U.S. Provisional Patent Application No. 62/231,028 filed in the name of Grant Jonathan Sanford on Jun. 23, 2015.

FIELD OF THE INVENTION

The present invention relates to devices which attach to frames of large architectural structures having a framework such as but not limited to reinforcement, also known as rebar, cages or curtains utilized in the construction of modern buildings, towers, bridges, and the like during construction of the architectural structure, and in particular to a climbing device which is releasably attachable to a substantially horizontal rung of a rebar cage or curtain of an architectural frame to provide secure footing or secure attachment for construction personnel to the rebar cage or curtain of the frame while working on the architectural structure.

BACKGROUND OF THE INVENTION

Reinforced cement concrete, or RCC, frame structures are a very common in the construction of modern office buildings, apartment dwellings, towers, bridges, and the like. This type of building consists of a structural framework or skeleton of concrete. Horizontal members of this frame are called beams, and vertical members are called columns. Humans walk on flat planes of concrete called slabs. Of these, the column is the most important, as it is the primary load-carrying element of the a frame structure as damage to a column could bring down the entire structure.

RCC is concrete that contains steel bars, called reinforcement bars, or rebars. This combination is used because concrete is very strong in compression, easy to produce at site, and inexpensive, and steel is very strong in tension. Reinforced concrete structures require a mold, called formwork, which will contain the poured liquid concrete and give it the form and shape desired. Workers position steel reinforcement bars in the mold and tie them in place using wire, or weld them together. The tied steel is called reinforcement or rebar cage or curtain, because of its shape, often with both vertical and horizontal bars coupled together. When the steel cage is in place, liquid concrete is poured into the formwork.

The construction of such large steel reinforced cement concrete structures, especially given modern earthquake survivability codes, requires dense three-dimensional and multi-layer reinforcement cages. As a result, construction personnel working on the cages, particularly those of the walls and columns, and climbing them like rungs of ladders, cannot easily fit the toes of their boots between adjacent bars and layers of bars to step on the horizontal steel bars. This difficulty in climbing the reinforcement cages makes for a slow and tedious process as the worker moves around the structure and often times places construction personnel in potentially hazardous positions during the construction of the structure. Consequently the worker must take great care to secure his footing and tether himself to the existing frame of the building. This slows the construction process, and consequently increases the cost of both the construction of the building, and its related costs such as insurance premiums.

A need exists for a climbing device which permits a worker to releasably attach a climbing device to the dense three-dimensional and multi-layer reinforcement cages, which provides both a secure footing, and a rapid movement across the reinforcement cages.

SUMMARY OF THE INVENTION

The present invention is a personal climbing apparatus that overcomes limitations of the prior art for climbing a framework such as but not limited to reinforcement or rebar cages or curtains of the type utilized in the construction of modern office buildings, apartment dwellings, towers, bridges, and the like.

According to one aspect of the invention, the apparatus for climbing includes a hanger having a blade extended from a shank and forming a gap therebetween; a foot-support platform that is oriented transversely to the shank of the hanger and coupled thereto, the foot-support platform further comprising a foot retainer; and a brace that is coupled between the foot-support platform and the shank of the hanger.

According to another aspect of the invention, the hanger of the climbing apparatus includes a gap adjuster for adjusting a width of the gap between the shank and the blade. According to another aspect of the invention, the brace of the climbing apparatus includes a linkage that is coupled between the foot-support platform and the shank of the hanger. The linkage is operable for adjusting an angle between the foot-support platform and the shank of the hanger.

According to another aspect of the invention, the foot-support platform of the climbing apparatus further includes a length adjuster for accommodating different users.

According to another aspect of the invention, the foot-support platform of the climbing apparatus further includes a foot retainer for securely and reliably retaining user's booted foot on the foot-support platform.

According to another aspect of the invention, a method is provided for climbing a framework such as but not limited to reinforcement or rebar cages or curtains of the type utilized in the construction of modern office buildings, apartment dwellings, towers, bridges, and the like, wherein the method includes providing a pair of climbing apparatus, the pair of apparatus individually accommodating each of a right foot and a left foot of a user, and wherein each of the pair of climbing apparatus has a hanger having a blade extended from an elongated shank through a bend and forming a gap therebetween, wherein the blade and bend and gap are adjacent to a blade end of the elongated shank, and a foot-support platform coupled to the shank of the hanger in a transverse orientation thereto and the foot-support platform is the sized for accommodating a foot of a user and further comprises a foot retainer. The method including placing a right foot of a user on the foot-support platform of a first of the pair of climbing apparatus, and operating the foot retainer corresponding to the foot-support platform of the first of the pair of climbing apparatus for securing the right foot of the user to the foot-support platform of the first of the pair of climbing apparatus. The method also including placing a left foot of a user on the foot-support platform of a second of the pair of climbing apparatus, then operating the foot retainer corresponding to the foot-support platform of the second of the pair of climbing apparatus for securing the left foot of the user to the foot-support platform of the second of the pair of climbing apparatus. Additionally, the method of the invention includes placing one of the first and second of the pair of climbing apparatus on a substantially horizontal member of the framework; placing a different one of the first and second of the pair of climbing apparatus on a substantially horizontal member of the framework; and climbing the framework by alternately moving each of the first and second of the pair of climbing apparatus on a different substantially horizontal member of the framework.

According to another aspect of the method invention, when the hanger of each of the pair of climbing apparatus further includes a gap adjuster for adjusting a width of the gap between the shank and the blade; and the method further includes adjusting the width of the gap to correspond to a size of the member of the framework. According to another aspect of the method invention, the hanger of each of the pair of climbing apparatus optionally further includes a brace coupled between the foot-support platform and a foot end of the shank of the hanger opposite from the blade end thereof, whereby the brace supports foot-support platform and a full weight of the user thereon.

According to another aspect of the method invention, the foot-support platform of the hanger of each of the pair of climbing apparatus optionally further includes at least one of a foot retainer comprising one or both of a toe retainer and a heel retainer, or the foot-support platform further comprises a length adjuster. When the foot-support platform of the hanger of each of the pair of climbing apparatus includes at one of a foot retainer having one or both of a toe retainer and a heel retainer, the method further includes operating the foot retainer for retaining each of the left foot of the user and the right foot of the user. When the foot-support platform of the hanger of each of the pair of climbing apparatus includes the length adjuster, the method further includes operating the length adjuster for adjusting a length of each of the foot-support platforms for accommodating a length of each of the left foot of the user and the right foot of the user.

Other aspects of the invention are detailed herein.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF PREFERRED EMBODIMENT

Figure 1:
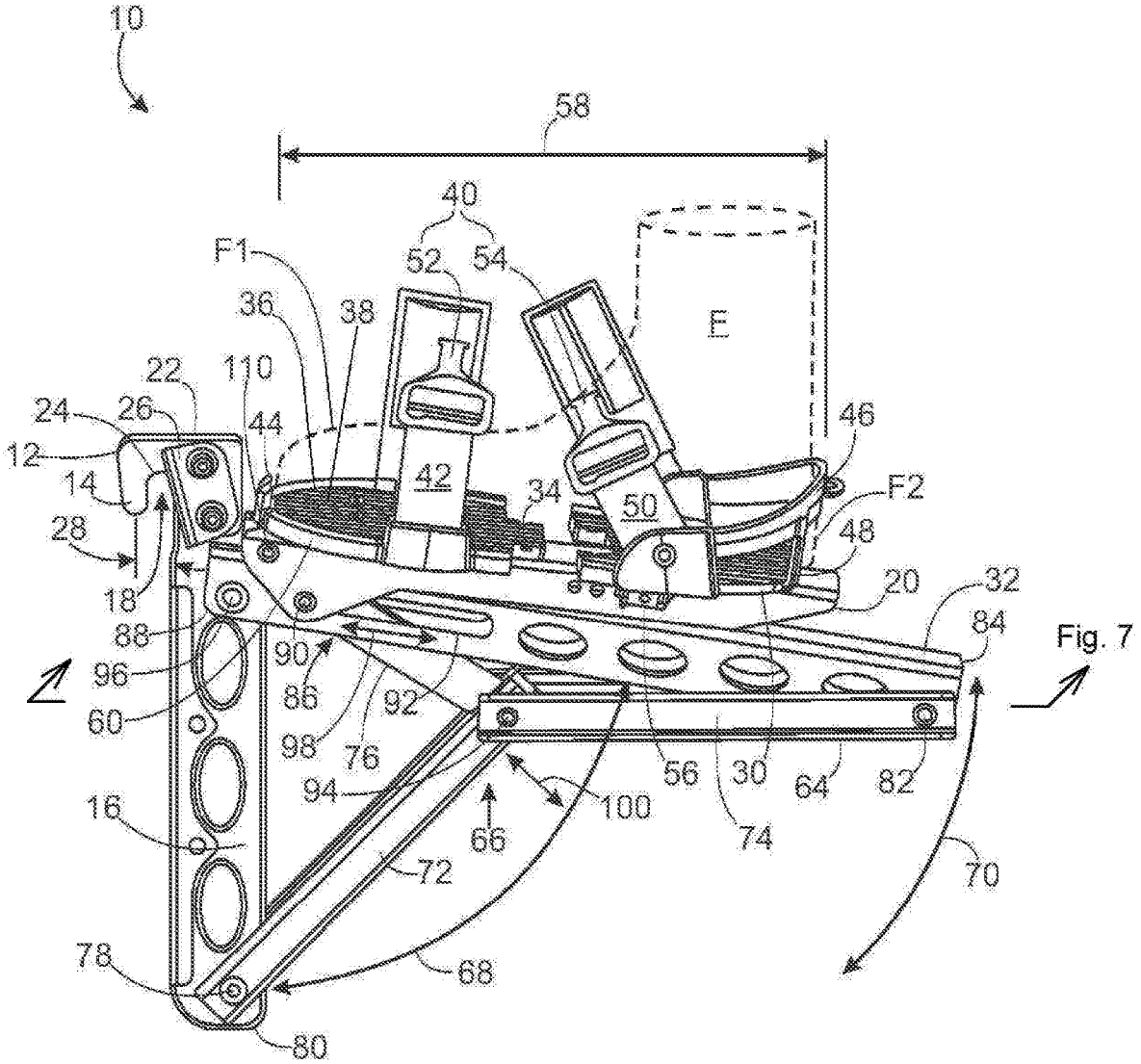
FIG. 1 is a side view that illustrates the invention embodied by example and without limitation as a climbing apparatus for climbing a framework such as but not limited to reinforcement, also known as rebar, cages or curtains of the type utilized in the construction of modern office buildings, apartment dwellings, towers, bridges, and the like, wherein the climbing apparatus is shown with a booted foot inserted therein and is depicted in a collapsed state.

As required, a detailed illustrative embodiment of the present protective enclosure is disclosed herein. However, techniques, systems and operating structures in accordance with the present protective enclosure may be embodied in a wide variety of forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein which define the scope of the present protective enclosure. The following presents a detailed description of an illustrative embodiment (as well as some alternative embodiments) of the present protective enclosure.

In the Figures, like numerals indicate like elements.

FIG. 1 through FIG. 4 all illustrate the invention embodied by example and without limitation as a climbing apparatus 10 for climbing a framework such as but not limited to rebar cages or curtains utilized in the construction of modern architectural structure, such as but not limited to buildings, towers, bridges, and the like during construction of the architectural structure. Climbing apparatus 10 fits on each of the user's feet and is removably attachable to a substantially horizontal rung of a rebar cage or curtain of an architectural frame to provide secure footing or secure attachment for construction personnel to the rebar cage or curtain of the frame while working on the architectural structure.

Climbing apparatus 10 is preferably constructed of a strong but lightweight metal material such as aluminum in order to support the weight of a person using the device and to prevent damage to the device during use. However, other suitable materials having a high impact strength or hardness may be utilized, including but not limited to carbon-fiber-reinforced polymer, carbon-fiber-reinforced plastic or carbon-fiber-reinforced thermoplastic (CFRP, CRP, CFRTP or often simply carbon fiber, or even carbon), which is an extremely strong and light fiber-reinforced plastic which contains carbon fibers.

Climbing apparatus 10 is composed of a hanger 12 having a blade 14 extended from a shank 16 and forming a gap 18 therebetween, and a foot-support platform 20 adapted for accommodating a booted foot F (dashed) of a user.

As disclosed here by example and without limitation, blade 14 of hanger 12 is positioned adjacent to one end 22 of shank 16. However, alternative positions of blade 14 along the length of shank 16 are also contemplated and may be included or substituted without deviating from the scope and intent of the present invention. Blade 14 and shank 16 are connected by a bend 24 at an interior end of blade 14, and a gap 18 is formed there between. Hanger 12 optionally includes a gap adjuster 26 for adjusting a width 28 of gap 18 between shank 16 and blade 14, whereby gap 18 is optionally adjusted for accommodating frameworks of various gauges or thicknesses.

Foot-support platform 20 is optionally formed as a foot step 30 that is mounted on a sturdy support member 32 formed, by example and without limitation, as a rigid arm, and rigid arm 32 is coupled in transverse orientation to shank 16 of hanger 12.

Step 30 is formed with an upper support surface or tread 34 which is sized to receive thereon the user's booted foot F, substantially as illustrated. Tread 34 of step 30 is optionally formed with a non-slip stepping surface 36 to reduce the possibility of slippage when a user is standing on step 30 of climbing apparatus 10. By example and without limitation, non-slip stepping surface 36 may be formed with a plurality of grip members 38 such as, but not limited to, raised protrusions that optionally surround a hole in tread 34, or "upwardly upset" portions. Other known forms of non-slip stepping surface are also contemplated and may be included or substituted for grip members 38 without deviating from the scope and intent of the present invention.

Climbing apparatus 10 also includes a foot-retainer mechanism 40 for securely and reliably retaining user's booted foot F on foot-support platform 20, or optional step 30 when present. As disclosed here by example and without limitation, foot-retainer mechanism 40 includes a foot insert or toe strap 42 adjacent to a first or toe end 44 of foot-support platform 20, or optional step 30, for receiving a toe F1 of user's booted foot F, a heel F2 of user's booted foot F is received into a heel support 46 adjacent to an opposite second end 48 of foot-support platform 20, or optional step 30, and an ankle strap 50 is positioned over an ankle F3 of user's booted foot F for securely retaining user's booted foot Fin heel support 46. Adjustment mechanisms 52 and 54 are provided on either or both of foot insert or toe strap 42 and ankle strap 50, whereby either or both of foot insert or toe strap 42 and ankle strap 50 is adjustable. Adjustment mechanisms 52 and 54 are, for example, buckles or hook-and-loop type closures such as Velcro®, or a combination thereof. However, alternative adjustment mechanisms 52 and 54 are also contemplated and may be included or substituted without deviating from the scope and intent of the present invention.

Foot step 30, optionally further includes a length adjuster mechanism 56 for adjusting a length 58 of foot step 30, for accommodating different sizes of booted foot F. For example, is constructed in two parts; a forward or toe support 60 and rearward or heel support 46, which toe support 60 and heel support 46 are separately mounted on foot step 30. Length adjuster mechanism 56 changeably fixes a distance (arrow 62) between toe support 60 and heel support 46. By example and without limitation, length adjuster mechanism 56 is a detent mechanism operable between either one or both of toe support 60 and heel support 46 of foot step 30 and a portion of foot-support platform 20.

Foot-support platform 20 is coupled to shank 16 of hanger 12 in transverse orientation to shank 16. Hanger 12 may be sufficiently sturdy to support the user's weight on foot-support platform 20 when foot-support platform 20 is cantilevered from shank 16 of hanger 12. Alternatively, an optional brace 64 is coupled between foot-support platform 20 and shank 16 of hanger 12 for supporting foot-support platform 20 and user's full weight thereon.

As disclosed here by example and without limitation, brace 64 of climbing apparatus 10 optionally includes an angle adjuster mechanism 66 for adjusting an angle 68 between foot-support platform 20 and shank 16. Angle adjuster mechanism 66, when present, permits user to change an angle 70 of his or her stance relative to the framework. For example, angle adjuster mechanism 66 of hanger 12 is optionally incorporated in to brace 64 for adjusting angle 68 between foot-support platform 20 and shank 16. By example and without limitation, angle adjuster mechanism 66 of brace 64 utilizes a linkage (shown) or other expandable-and-contractible mechanism coupled between both foot-support platform 20 and shank 16 of hanger 12. Here, linkage-type expandable-and-contractible angle adjuster mechanism 66 is represented as three rigid linkage members 72, 74 and 76 that cooperate to form brace 64. For example, one linkage member 72 is rotatably coupled to shank 16 through a rotational coupling 78 located adjacent to a base end 80 thereof opposite of end 22 having blade 14 of hanger 12. Second linkage member 74 is rotatably coupled through a rotational coupling 82 located adjacent to an aft end 84 of rigid arm 32 of foot-support platform 20; and third linkage member 76 is slidably coupled to rigid arm 32 through a slidable coupling 86 located adjacent to a forward end 88 thereof opposite from aft end 84. For example, slidable coupling 86 is formed between a pin 90 positioned adjacent to forward end 88 of foot-support platform 20 slidably coupled between third linkage member 76 and a slot 92 through support member 32, which slidable coupling 86 slidably couples third linkage member 76 to support member 32 under the operation of foot step 30. These three linkage members 72, 74 and 76 are joined in a rotational coupling 94 opposite from each of corresponding couplings 78, 82 and 86.

As also disclosed here by example and without limitation, angular adjustment of foot-support platform 20 of climbing apparatus 10 to shank 16 is accommodated by a rotational coupling 96 therebetween. For example, foot-support platform 20 is optionally is optionally rotatably coupled to shank 16 through rotational coupling 96 located between first or toe end 44 of foot-support platform 20 and end 22 of shank 16.

In operation, sliding movement (arrow 98) of slidable coupling 86 causes rotational coupling 94 to move (arrow 100) toward or away from shank 16, which in turn causes first and second linkage members 72 and 74 to rotate about respective rotational couplings 78 and 82 between a collapsed or angled relationship (FIG. 1) and an extended or substantially parallel or near parallel relationship (FIG. 2) thereby extending angle 68 between foot-support platform 20 and shank 16 and concurrently extending angle 70 of user's stance relative to the framework toward perpendicular. Opposite sliding movement (arrow 98) toward shank 16 results in moving angle adjuster mechanism 66 toward the collapsed or angled relationship (FIG. 1) of linkage members 72, 74 and 76 reducing angle 68 between foot-support platform 20 and shank 16 and concurrently reducing angle 70 of user's stance relative to the framework away from perpendicular.

Figure 3:
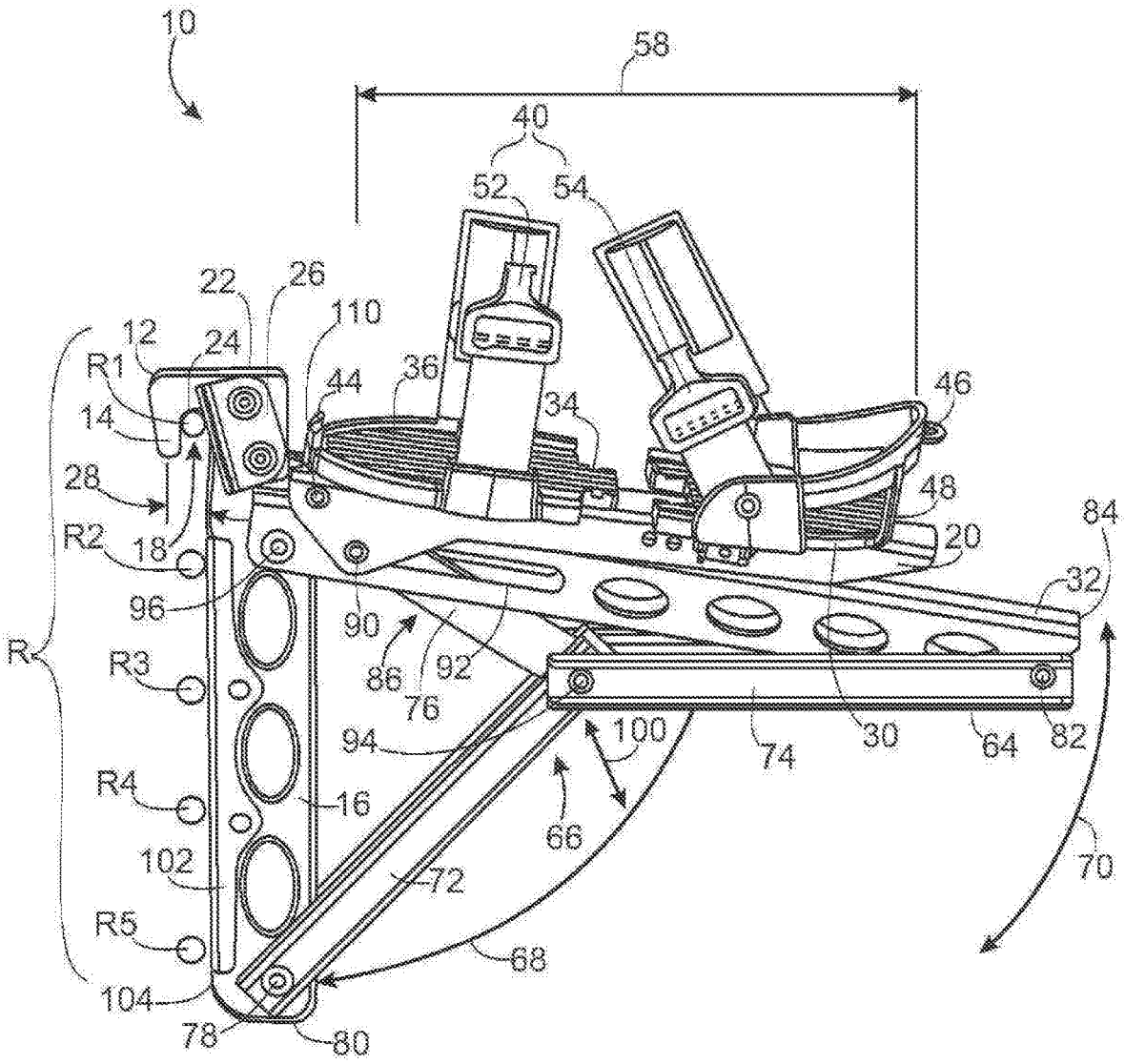
FIG. 3 is another view that illustrates the climbing apparatus of FIG. 1, wherein the booted foot is omitted for clarity and including a plurality of substantially horizontal rungs of a rebar cage or curtain of an architectural frame.

FIG. 3 illustrates climbing apparatus 10 of FIG. 1 releasably attached to a substantially horizontal rung R1 of a rebar cage or curtain R of an architectural frame consisting of a plurality of substantially horizontal rungs R2-R5 for providing secure footing or secure attachment for construction personnel to the rebar cage or curtain of the frame while working on the architectural structure.

Here, width 28 of gap 18 is adjusted via gap adjuster 26 for receiving thereinto substantially horizontal rung R1 of rebar cage or curtain R. Thereafter, climbing apparatus 10 hangs on rebar cage or curtain R via hanger 12 with shank 16 resting against plurality of substantially horizontal rungs R2-R5 thereof.

Optionally, a protective faceplate or guard plate 102 may be mounted on an operational surface 104 of shank 16. Guard plate 102, if present, protects the integrity of shank 16 against wear and damage that may be caused by repeated interactions with rungs R1-R5 of rebar cage or curtain R. According to one embodiment of the invention, guard plate 102 is optionally removable and replaceable.

Figure 2:
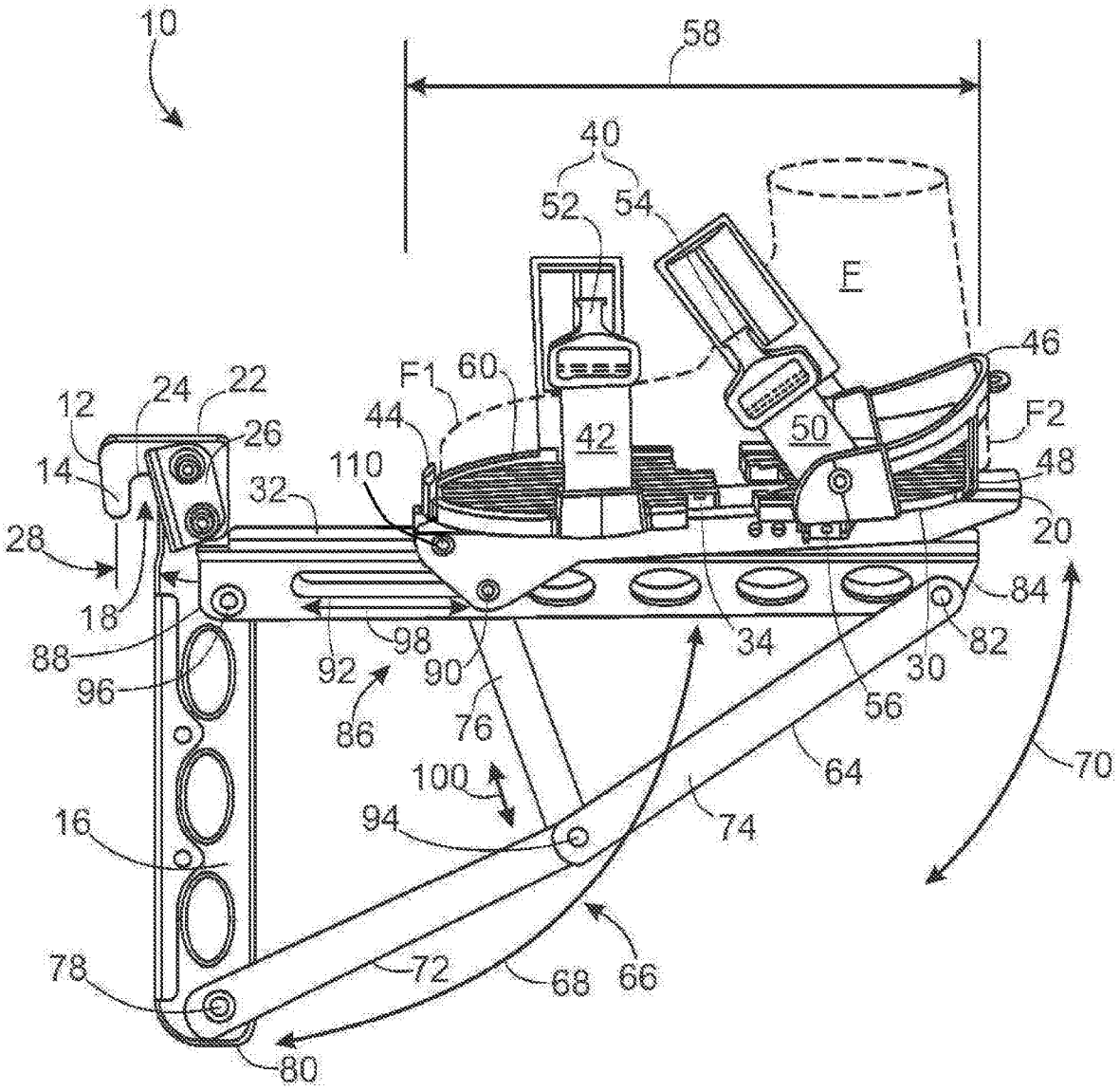
FIG. 2 is a side view that illustrates the climbing apparatus of FIG. 1, wherein the climbing apparatus is shown with a booted foot inserted therein and is depicted in an expanded state.
Figure 4:
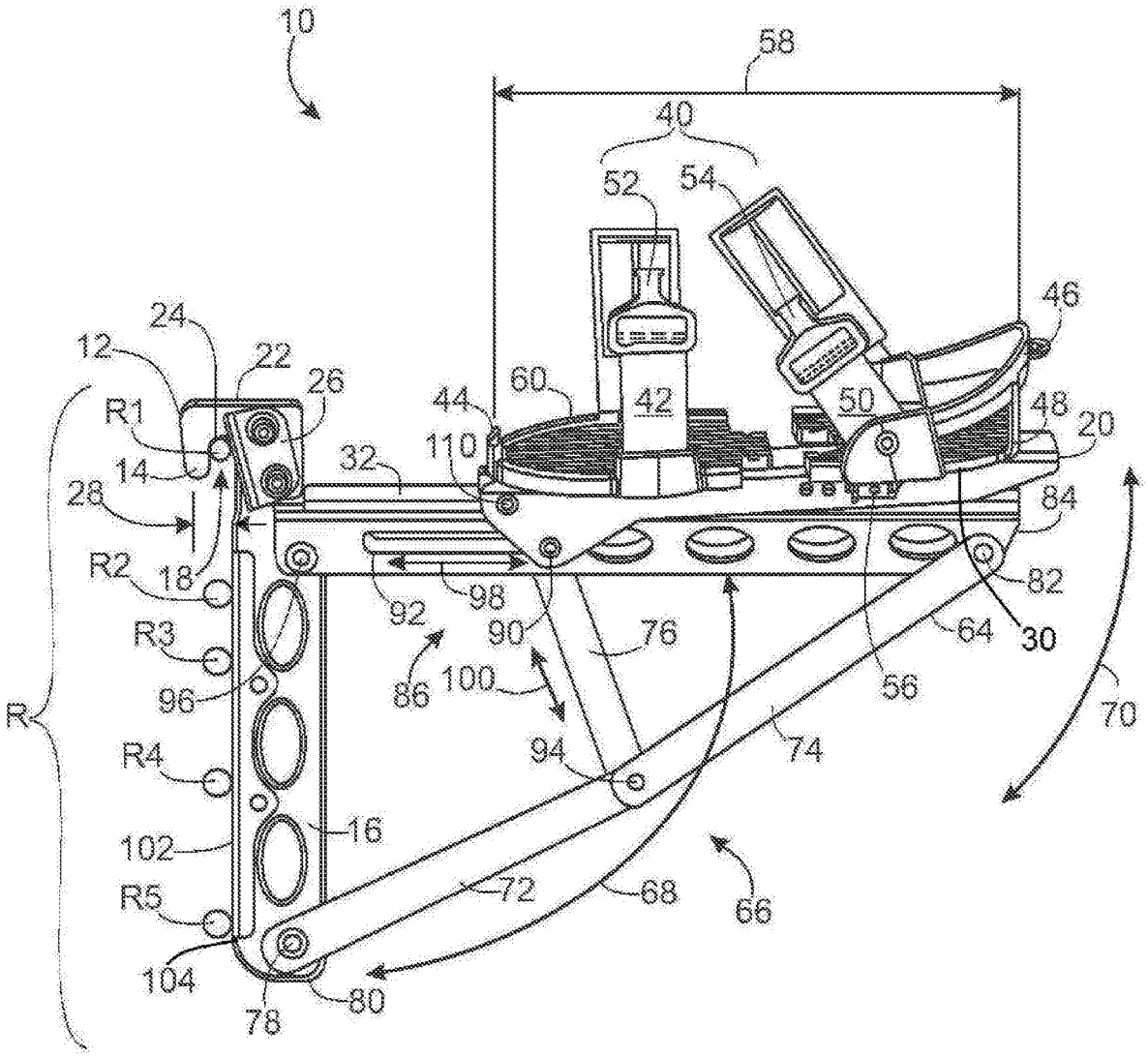
FIG. 4 is another view that illustrates the climbing apparatus of FIG. 1, wherein the booted foot is omitted for clarity and including a plurality of substantially horizontal rungs of a rebar cage or curtain of an architectural frame.

FIG. 4 is another view that illustrates climbing apparatus 10 of FIG. 1 releasably attached to a substantially horizontal rung R1 of rebar cage or curtain R of an architectural frame. Here, sliding operation (arrow 98) of slidable coupling 86 results in angle adjuster mechanism 66 extending angle 68 between support member 32 and shank 16 and concurrently extending support member 32 and foot-support platform 20, whereby angle 70 of user's stance is extended relative to the framework toward perpendicular. Operation of sliding operation (arrow 98) of slidable coupling 86 and angle adjuster mechanism 66 results in rotatable linkage members 72 and 74 being extended into the substantially parallel or near parallel relationship (FIG. 2). As illustrated here, appropriate sizing of linkage members 72, 74 and 76 in combination with sizing of slot 92 through support member 32 optionally results in linkage members 72 and 74 being extended beyond parallel into an over-center relationship with third linkage member 76 such that support member 32 and shank 16 are substantially locked in the substantially perpendicular relationship illustrated here and in FIG. 2.

Figure 5:
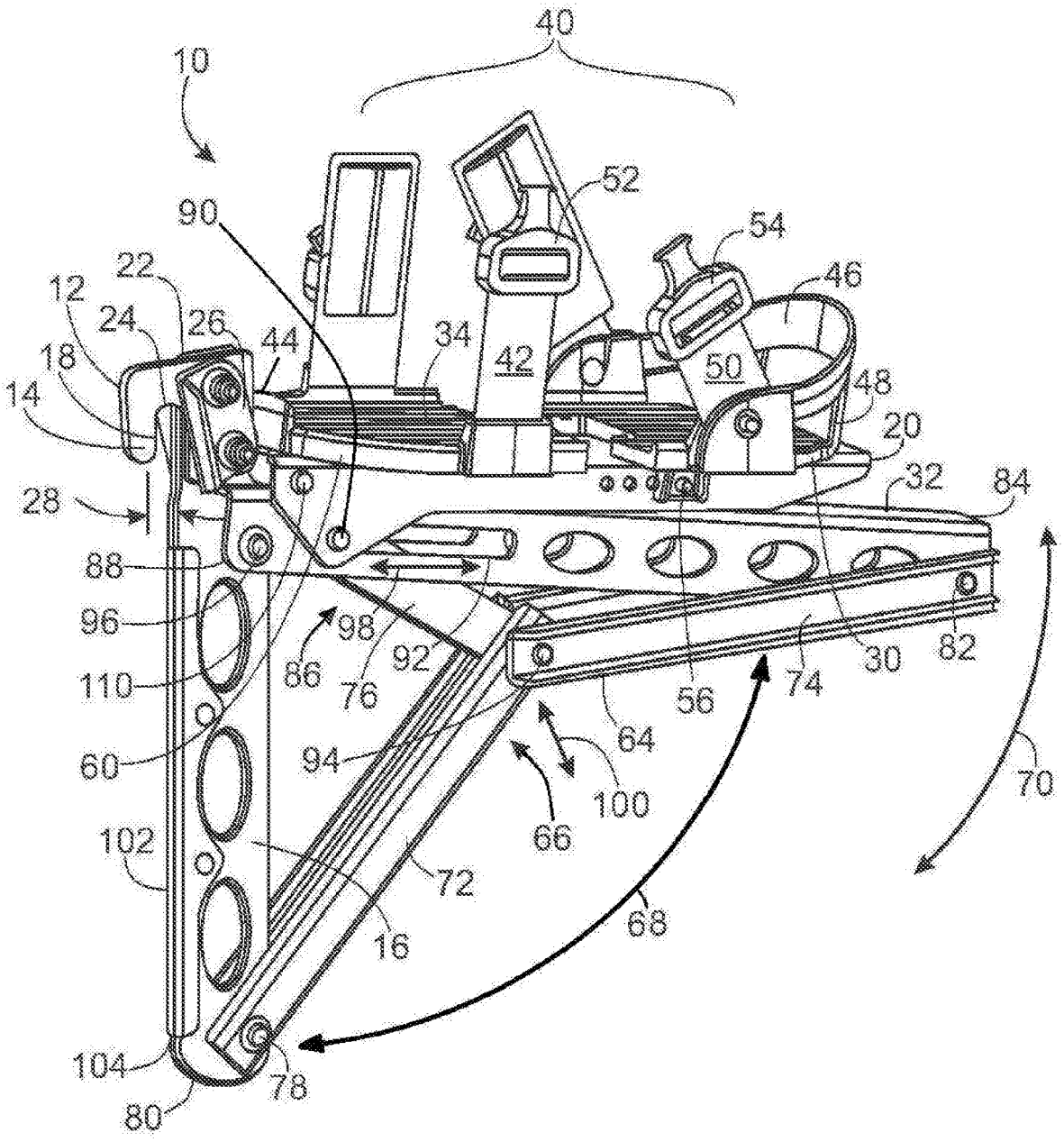
FIG. 5 is a frontal perspective view of the climbing apparatus of FIG. 1 that more clearly illustrates an optional protective faceplate or guard plate that may be mounted on an operational surface of the climbing apparatus.

FIG. 5 is a frontal perspective view of climbing apparatus 10 of FIG. 1 that more clearly illustrates protective faceplate or guard plate 102 that may be mounted on operational surface 104 of shank 16.

Figure 6:
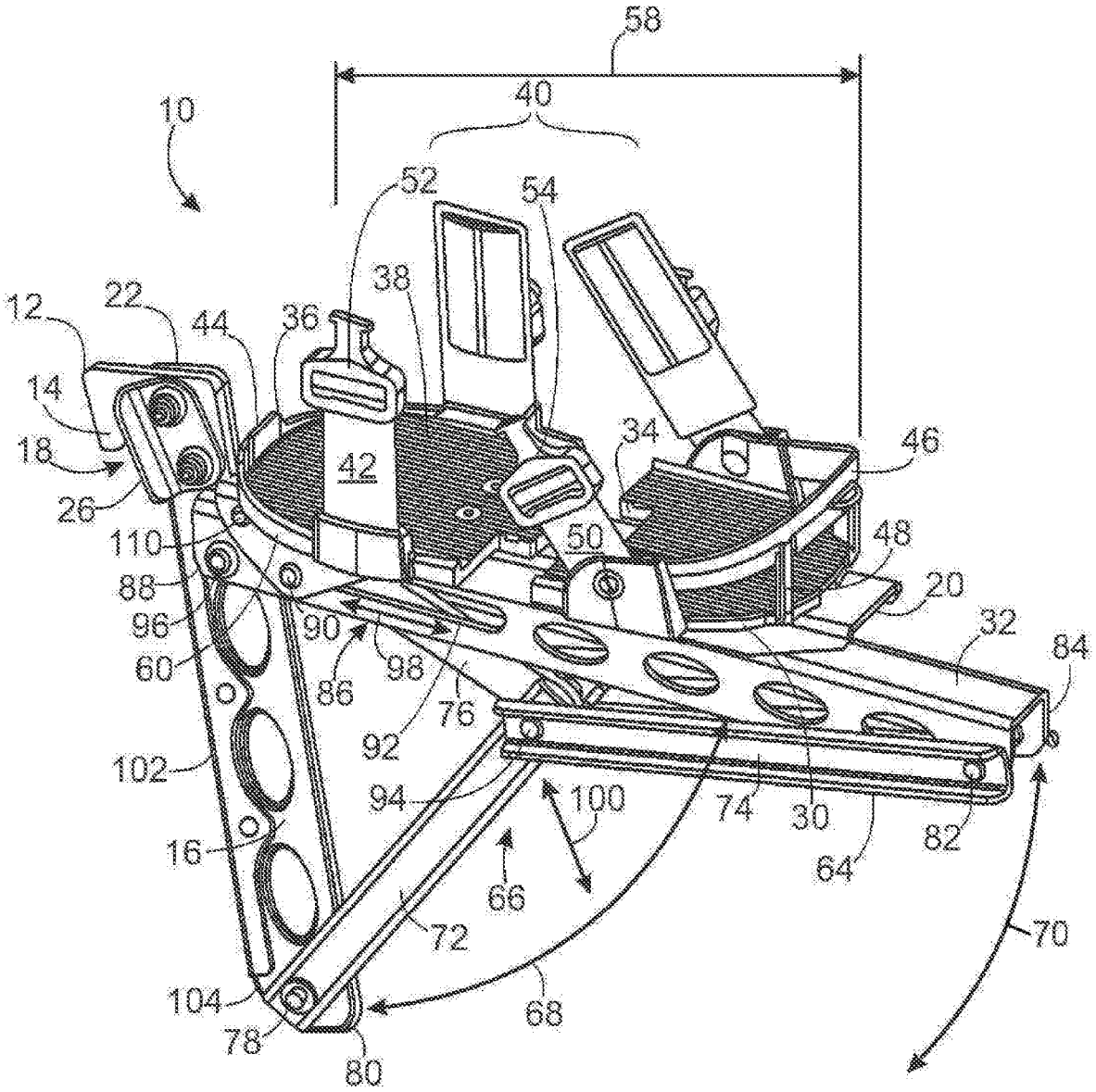
FIG. 6 is a top rear perspective view of the climbing apparatus of FIG. 1.

FIG. 6 is a top rear perspective view of climbing apparatus 10 of FIG. 1.

Figure 7:
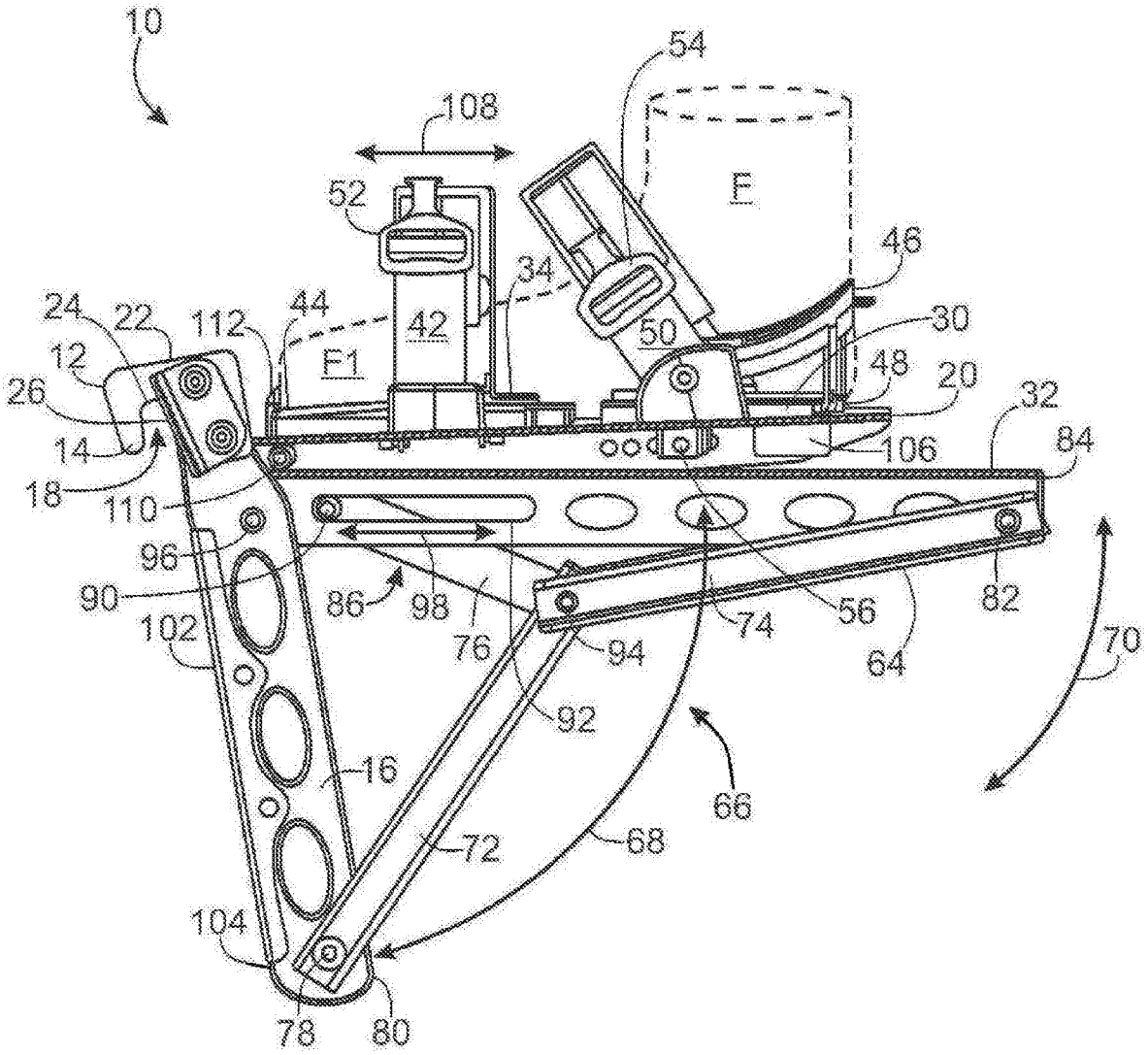
FIG. 7 is a cross-section view of the climbing apparatus of FIG. 1 that illustrates an optional brake for arresting movement of the climbing apparatus at a selected one of the expanded state illustrated in FIG. 2 and the collapsed state illustrated in FIG. 1, or at another selected stance angle therebetween.

FIG. 7 is a cross-section view of climbing apparatus 10 of FIG. 1. As illustrated, a brake 106 is optionally positioned between foot step 30 and rigid arm 32 of foot-support platform 20. Optional brake 106, if present, is operable for arresting sliding movement (arrow 98) of slidable coupling 86 toward or away from shank 16, whereby the relationship of linkage members 72, 74 and 76 is fixed at a selected angle 68 in either the collapsed relationship (FIG. 1) or the extended relationship (FIG. 2) thereof until brake 106 is released. Alternatively, brake 106 is operable for arresting sliding movement (arrow 98) of slidable coupling 86 for fixing the relationship of linkage members 72, 74 and 76 at a different selected angle 68 in between the collapsed relationship (FIG. 1) and the extended relationship (FIG. 2) thereof until brake 106 is released. According to one embodiment, brake 106 is a friction brake, such as an elastomer disc or pad (shown), that brakes by engaging a surface of rigid arm 32, and releases by disengaging from such surface. However, alternative brakes 106 other than friction brakes are also contemplated and may be included or substituted without deviating from the scope and intent of the present invention. Accordingly, user is able to work at a selected stance angle 70 relative to the framework within a range of stance angles 70.

As disclosed here by example and without limitation, brace 64 of hanger 12 optionally includes angle adjuster mechanism 66 for adjusting an angle 68 between foot-support platform 20 and shank 16, adjuster mechanism 66 permits user to change an angle 70 of his or her stance relative to the framework.

Additionally, when angle adjuster mechanism 66 of brace 24 is practiced utilizing a linkage (shown) or other expandable-and-contractible mechanism such as angle adjuster mechanism 66, foot-support platform 20 is movable (arrow 108) toward and away from shank 16, within the throw (at arrow 98) of pin 90 in slot 92 through support member 32, for adjusting user's position relative to shank 16 and framework. A slide or roller (shown) 110 may be optionally provided between toe end 44 of foot-support platform 20, or optional step 30, and rigid support member 32 for ease of moving (arrow 108) foot-support platform 20 relative to shank 16.

As more clearly shown here, foot-retainer mechanism 40 may include a toe stop 112 adjacent to toe end 44 of foot-support platform 20, or optional step 30, as a stop for toe end F1 of user's booted foot F.

In use, it is contemplated that climbing apparatus 10 includes some fastening means, such as a tether, for retaining or safety line and ultimately connected to a harness attached to the user's body.

While the preferred and additional alternative embodiments of the invention have been illustrated and described, it will be appreciated that various changes can be made therein without departing from the spirit and scope of the invention. Therefore, it will be appreciated that various changes can be made therein without departing from the spirit and scope of the invention. Accordingly, the inventor makes the following claims.

What is claimed is:

1. A apparatus, comprising:

a shank;

a hanger attached to a top portion of the shank, the hanger forming a hook configured to attach to a framework, wherein the hanger comprises a gap adjuster to adjust a distance between the hanger and the shank;

a support member coupled to the shank, the support member comprising a slot extending along at least a portion of the support member, wherein the support member is configured to rotate about a first axis relative to the shank;

an adjuster mechanism coupled to the shank and the support member, the adjuster mechanism being configured to adjust an angle between the shank and the support member, wherein the adjusted mechanism comprises:

a first linkage comprising a first end coupled to a bottom portion of the shank and a second end coupled to a second linkage and a third linkage;

the second linkage comprising a first end slidably coupled to the slot of the support member and a second end coupled to the first linkage and the third linkage; and the third linkage comprising a first end coupled to a back portion of the support member and a second end of the first linkage and the second linkage, wherein the first linkage, the second linkage, and the third linkage are rotationally coupled such that the first linkage, the second linkage, and the third linkage are configured to rotate about a second axis to adjust the angle between the shank and the support member;

a foot-support platform coupled to a top surface of the support member; and a binding configured to secure a boot or a foot to the foot-support platform.

2. The apparatus of claim 1, wherein the hook is positioned adjacent to one end of the shank.

3. The apparatus of claim 1, wherein the hanger further comprises a gap adjuster for adjusting an interior width of the hook.

4. The apparatus of claim 1, wherein the support member further comprises an angle adjuster between the foot-support platform and the shank.

5. The apparatus of claim 1, wherein the foot-support platform further comprises a length adjuster to adjust a distance between the foot-support platform and the shank.

6. The apparatus of claim 1, wherein the shank of the hanger further comprises an operational surface covering a long edge of the shank.

7. The apparatus of claim 6, wherein the operational surface of the shank further comprises a protective plate mounted thereon.

8. The apparatus of claim 1, further comprising a relative position adjuster coupled between the foot-support platform and the hanger.

* * * * *